United States Patent [19]

Boros

[11] Patent Number: 4,998,329

[45] Date of Patent: Mar. 12, 1991

[54] CONVERTIBLE FOOTWEAR

[76] Inventor: Leslie A. Boros, 7074 E. Aster Dr., Scottsdale, Ariz. 85254

[21] Appl. No.: 369,086

[22] Filed: Jun. 19, 1989

Related U.S. Application Data

[63] Continuation-in-part of Ser. No. 105,715, Oct. 6, 1987, Pat. No. 4,839,948, which is a continuation-in-part of Ser. No. 866,777, May 23, 1986, abandoned, which is a continuation of Ser. No. 681,844, Dec. 14, 1984, abandoned.

[51] Int. Cl.[5] ..... A41F 1/00

[52] U.S. Cl. ..... 24/662; 24/664

[58] Field of Search ..... 24/662, 664, 614, 679, 24/681, 303

[56] References Cited

U.S. PATENT DOCUMENTS 278,346 5/1883 Long .
2,637,887 5/1953 Goodman et al. .
3,108,346 10/1963 Bey .
3,166,771 1/1965 Kline et al. .
3,376,616 9/1968 Kactorowski .
3,589,341 6/1971 Krebs .
3,621,690 11/1971 Whitcomb .
4,458,392 7/1984 Pogharian et al. .
4,466,162 8/1984 Pogharian et al. .

*Primary Examiner*—Laurie K. Cranmer
*Attorney, Agent, or Firm*—Don J. Flickinger; Jordan M. Meschkow; Lowell W. Gresham

[57] ABSTRACT

A receptacle residing within a recess in the sole of a shoe includes an opening located along the edge of the shoe. A lug, receivable through the opening within the receptacle is carried by a flap extending from the upper of the shoe. An indentation carried by the lug is matingly engageable with a protrusion residing within the receptacle. Pressure from the foot of the wearer upon the sole of the shoe prevents disengagement of the lug from the receptacle.

4 Claims, 9 Drawing Sheets

CONVERTIBLE FOOTWEAR

BACKGROUND OF THE INVENTION

1. Cross Reference To Related Applications

This application is a Continuation-In-Part Application of application Ser. No. 105,715, filed 6 Oct. 1987, now U.S. Pat. No. 4,839,948, which was a Continuation-In-Part Application of application Ser. No. 866,777, filed 23 May 1986, now abandoned, which was a continuation of application Ser. No. 681,844, filed 14 Dec. 1984 now abandoned.

2. The Prior Art

The typical person usually owns numerous items of clothing in various styles and colors. The characteristic woman, for example, generally possesses an array of dresses, skirts, blouses, sweaters, jackets and other items which are alternately worn in "mix and match" fashion. To complement the clothing and complete the style image, requires judicious selection of footwear.

Footwear tends to be a relatively expensive item of dress. Accordingly, in the usual wardrobe, the selection of apparel exceeds the available footwear. To insure the availability of an appropriate choice, the typical dresser usually limits the wardrobe to comparatively few pairs of footwear in carefully chosen basic colors and styles.

In view of the foregoing synopsis of a generalized enigma, the desirability of footwear with convertible style is readily appreciated. In recognition of the long standing problem, the prior art has proposed numerous purported solutions. Attention is directed to U.S. Pat. No. 4,363,177, which sets forth a specific configuration. The reference also contains a more detailed treatment of the subject and includes citations to other prior art endeavors.

Of particular immediate interest are the replaceable uppers. The concept is well established. Briefly, a sole is provided with a plurality of interchangeable uppers. Preferably, the sole is in a basic or neutral color. The uppers are supplied in an array of colors and designs. Accordingly, the user, at a relatively reduced cost, can have a pair of shoes which compliment the chosen apparel.

The prior art has not, however, provided an entirely adequate solution. As clearly pointed out in the referenced patent ". . . serious questions are raised as to the robustness of the attachments and locking members for the removable elements". Additionally, the prior art has not satisfactorily accommodated the convenience of the user.

It would be highly advantageous, therefore, to remedy the foregoing and other deficiencies inherent in the prior art.

Accordingly, it is an object of the present invention to provide improvements in convertible footwear.

Another object of the invention is the provision of improved engagement means for detachably securing the upper to the sole of the shoe.

And another object of the invention is to provide engagement means which are readily and conveniently usable.

Still another object of this invention is the provision of engagement means which will reliably and securea-bly affix an upper to a sole.

Yet another object of the invention is to provide means whereby the holding ability of the engagement means will be reinforced in response to a foot being inserted into the shoe.

Yet still another object of the instant invention is the provision of unobtrusive engagement means whereby the attachment of an upper to a sole is obscured from view.

And a further object of the invention is to provide engagement means in the form of a separately manufacturable clasp which can be used in connection with otherwise conventional footwear.

Still a further object of the invention is the provision of a clasp which is usable for securing a first component to a second component, such as the ends of a belt.

And yet a further object of the invention is to provide a reversible clasp which enables two components to be secured to one another even when one or both of the components are inverted.

And still a further object of the invention is to provide an engagement means or clasp, of the above character, which is inexpensively yet durably constructed.

SUMMARY OF THE INVENTION

Briefly, to achieve the desired objects of improved convertible footwear in accordance with an embodiment of the invention, there is provided a shoe including a sole having substantially opposed edges and an upper having projecting flaps. A male element of a male/female engagement pair is carried by each flap. Female elements of the male/female engagement pair are carried by the sole. Each female element, which preferably resides within a recess formed into the sole, includes an opening in the respective edge for receiving a respective male element.

In accordance with a further embodiment of the invention, provided are detent means interacting between the elements of the engagement pair for selectively and detachably retaining the male element within the female element. The force exerted by the detent means for maintaining the engagement is reinforced in response to the pressure of a foot bearing upon the top surface of the sole.

In a more specific embodiment, the female element is in the form of a receptacle and the male element is in the form of a tab. The detent means includes an indentation carried by one of the elements and protrusion carried by the other of the elements. Both the indentation and the protrusion may be symmetrically configured to allow engagement when either of the components are inverted. The indentation and the protrusion are normally retained in a mating engagement by biasing means. The biasing means is movable to a release position in response to application of a force to withdraw the male element in a direction generally parallel to the longitudinal axis of the engagement pair. It is also contemplated that a magnetic attraction may exist between the male element and the female element.

The engagement pair also has utility as a clasp for detachably securing a first component to a second component, such as the ends of a belt. Both elements are provided with attachment means for affixing respective ones of the components.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings in which.

DETAILED DESCRIPTION OF THE PREFERRED EMBODIMENTS

Figure 1:
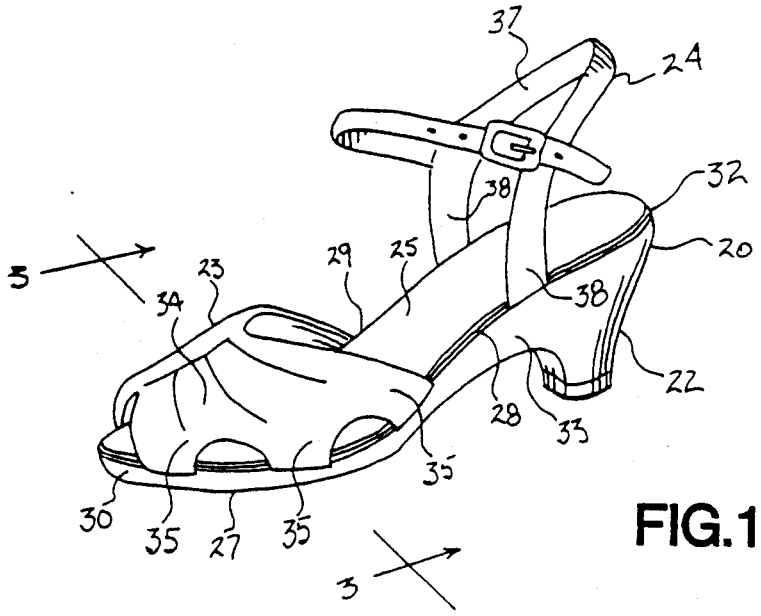
FIG. 1 is a perspective view of convertible style footwear embodying the principles of the instant invention, which for purposes of illustration is shown in the exemplary form of a readily recognizable ladies' shoe.

Turning now to the drawings, in which like reference characters indicate corresponding elements throughout the several views, attention is first directed to FIG. 1 which illustrates a shoe generally designated by the reference character 20 and embodying the principles of the instant invention. Shoe 20, as is standard within the art, includes sole 22 and first and second uppers 23 and 24, respectively.

Sole 22 includes an upper surface 25 for receiving the foot of the wearer thereon, a bottom surface 27 for bearing upon the ground and spaced apart edges 28 and 29. The edges 28 and 29 which generally meet at the toe end 30 and heel end 32 of sole 22 are considered to be the lateral portions of sidewall 33 which extends continuously between top surface 29 and bottom surface 27.

First upper 23, which resides proximate toe end 30, includes flexible element 34 having extending flaps 35. Second upper 24, in general similarity to first upper 23, includes flexible element 37 and flaps defining projecting terminal end portions 38.

The foregoing description of shoe 20 is herein set forth for purposes of orientation and understanding in connection with the instant invention. Shoe 20, herein shown in a distinctive ladies' style, is intended to be generally representative of that class of wearing apparel generally referred to as footwear. Details not specifically illustrated will be readily apparent and understood by those skilled in the art. For example, sole 20 may be constructed of such material as leather, wood or plastic. The flexible elements 24 and 37 are generally fabricated of leather, plastic, cloth or other material chosen to be both decorative and functional.

Figure 2:
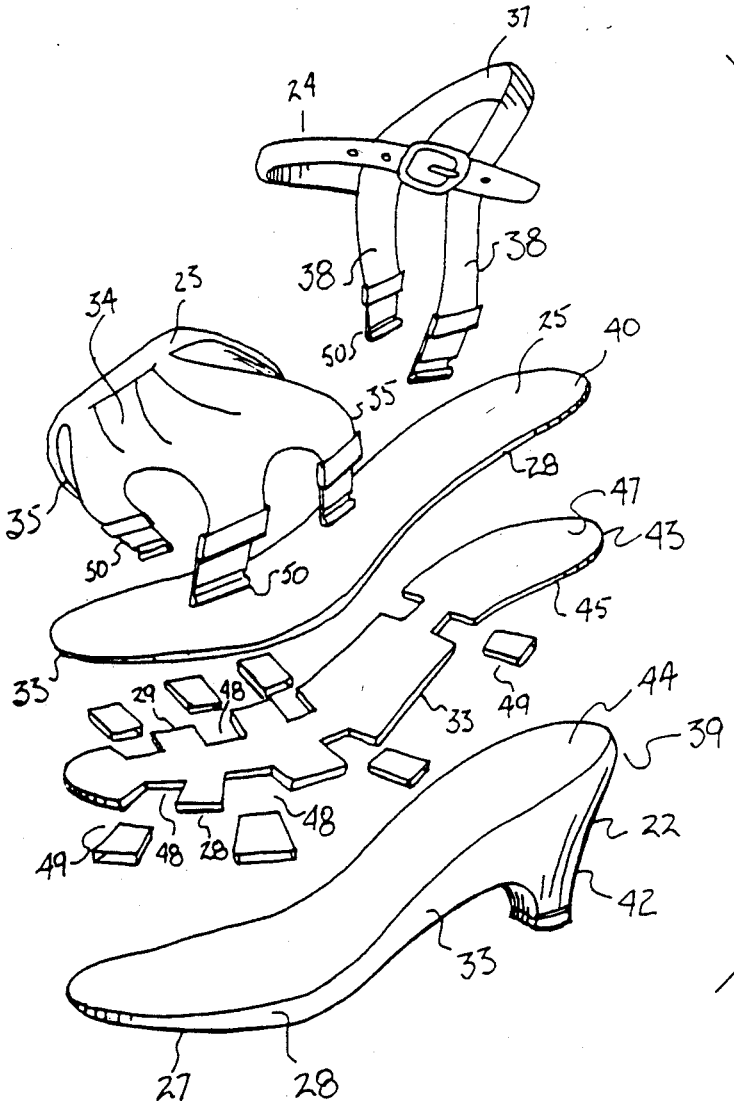
FIG. 2 is an exploded perspective view of the shoe of FIG. 1.

In accordance with the immediately preferred embodiment of the instant invention, sole 22 as seen in greater detail in FIG. 2, includes a support member 39 and a foot pad 40. Support member 39, in turn, includes lower portion 42 and upper portion 43. Lower portion 39, which carries bottom surface 27, includes upper surface 44 for receiving the under surface 45 of upper portion thereon. Over surface 47 of upper portion 43 receives foot pad 40. Lower portion 42, upper portion 43 and foot pad 40 are sandwiched together and secured in juxtaposition by gluing, sewing or other expediency conventional in the art.

A plurality of recesses 48 are formed in upper portion 43 of sole 22. In the immediate embodiment, each recess 48 is open in both the over and under surfaces 47 and 45, respectively, of upper portion 43. The recesses are also open in respective edges 28 and 29. Each recess 48 is sized and shaped to receive a female element 49 of a male/female engagement pair. Preferably upper portion 43 has a thickness generally corresponding to the thickness of the female elements 49. A male element 50 of the male/female engagement pair is carried by each flap 35 and 38. The male/female engagement pair will be hereinafter described in greater detail.

The male/female engagement pair, including female element 49 and male element 50, and the use thereof for detachably securing first and second upper 23 and 24, respectively, to sole 22 in the immediate embodiment of the invention generally designated by the reference character 20 is more clearly illustrated with reference to FIGS. 3, 4 and 5. With particular reference to FIG. 5, it is seen that female element 49 includes first and second substantially parallel sidewalls 52 and 53, respectively, held in spaced relationship by edge walls 54 and 55 and end wall 57. The several walls define a receptacle having an open end 58. Sidewall 52 is integral with or secured to edge walls 54 and 55 along a length thereof adjacent open end 58. For the remaining portion, sidewall 52 is independent of edge walls 54 and 55. Sidewall 55 is also independent of end wall 57 as indicated by the line 59. An inwardly directed protrusion 60 extends laterally across sidewall 53 proximate end wall 57. It is noted that protrusion 60 is curviform in cross-section.

Male element 50, being generally rectangular in cross-section, includes top surface 62, bottom surface 63 and edges 64 and 65. Further included are first end 67 and second end 68. Recess 69 is formed into surface 63 proximate end 67. The recess, which is generally curviform in cross-section, extends transverse of surface 63. Attachment means 70 for affixing flaps 35 or 38 are carried proximate end 68. In accordance with the immediately preferred embodiment, attachment means 70 includes a pair of spaced part lips 72 between which the flaps can be crimped, glued or otherwise secured. A shoulder 73 resides between the lips 72 and the respective surfaces 62 and 63.

Figure 3:
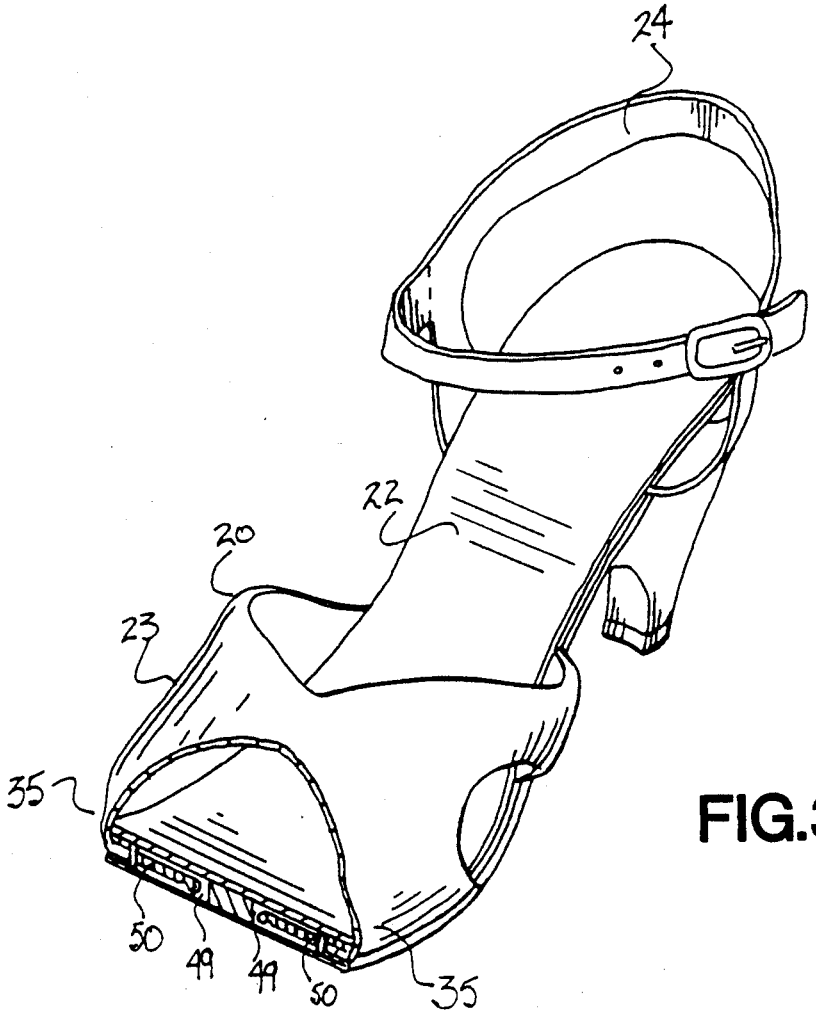
FIG. 3 is an enlarged perspective view of the shoe of FIG. 1, the toe portion being removed along the line 3—3 of FIG. 1 and specifically revealing the normally obscured means in accordance with the preferred embodiment of the instant invention for securing an upper to the sole.
Figure 4:
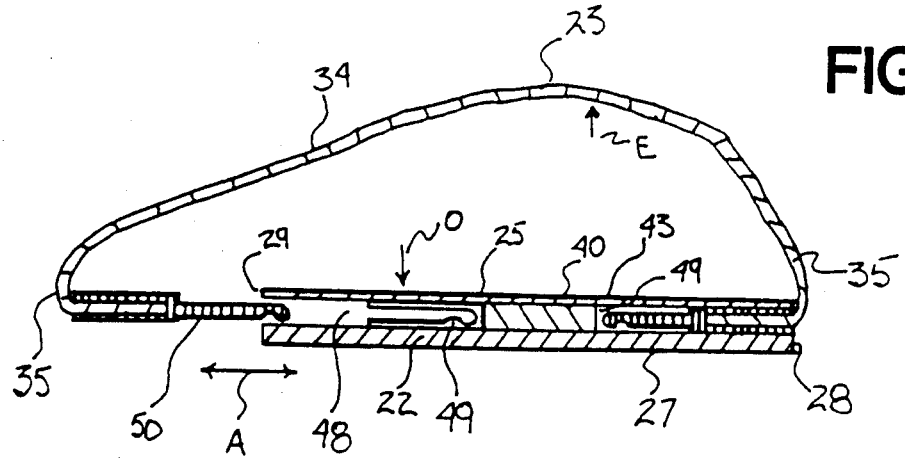
FIG. 4 is an enlarged vertical, sectional view taken at the cutting plane indicated in FIG. 1.
Figure 5:
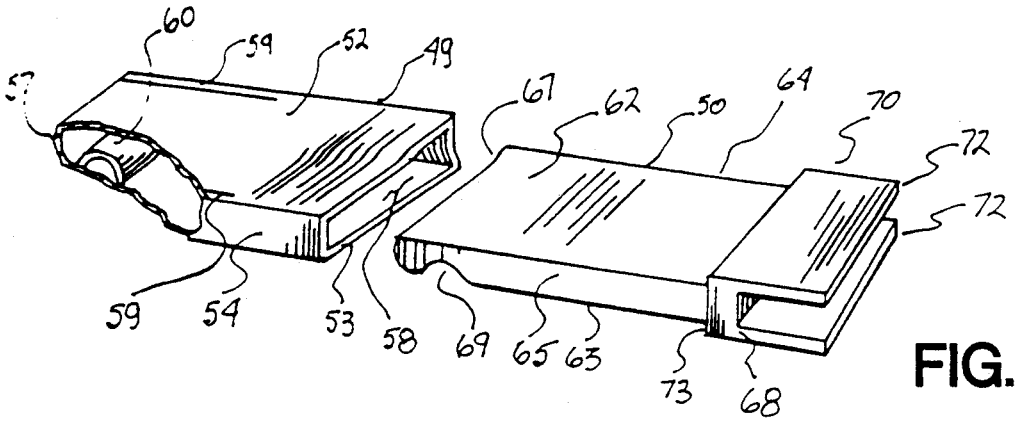
FIG. 5 is an enlarged perspective view of the male and female and elements of the male/female engagement pair seen in FIGS. 2, 3 and 4 and utilized for detachably securing the uppers to the sole, portions thereof being broken away for purposes of illustration.

With particular reference to FIGS. 3 and 4, it is seen that each recess 48 has a horizontal depth at least equal to the combined length of the female receptacle 49 and the lip 72. The female element 49 resides at the inner end of recess 48. Accordingly, the entire male/female engagement pair can be obscured within recess 48, as particularly illustrated in FIG. 3.

Figure 5A:
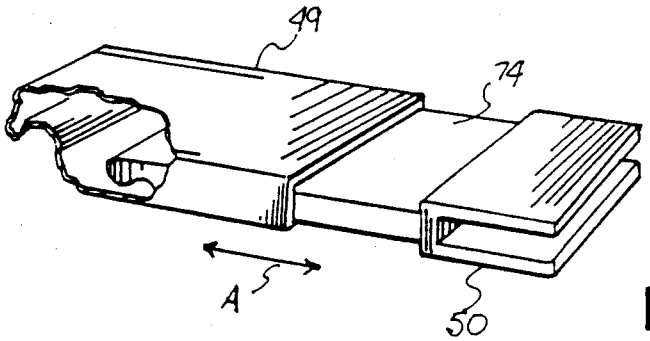
FIG. 5A is a view generally corresponding to the view of FIG. 5 and showing the engagement pair during an initial stage of engagement.

The surface and the edges 62, 63, 64 and 65, define a lug of the male component 50 which is receivable through the opening 58 into the receptacle of the female component 49 as best seen in FIG. 5A. The lug is receivable into the receptacle and alternately removable therefrom, in directions which are substantially parallel to the longitudinal axis of the male/female engagement pair as shown by the double arrowed line A. With further reference to FIG. 4, it is seen that the directions indicated by the double arrowed line A are substantially parallel to the top and bottom surfaces 25 and 27, respectively, of the sole 22.

Figure 5B:
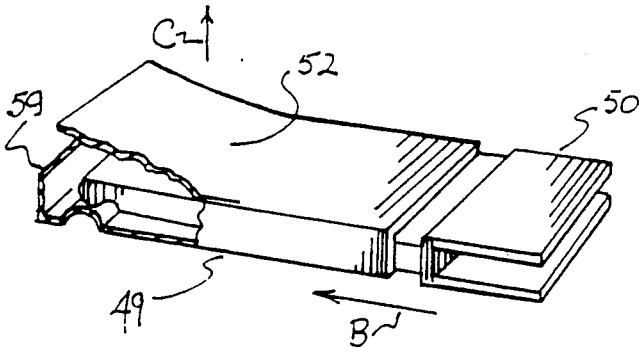
FIG. 5B is a view generally corresponding to the view of FIG. 5A and showing the components thereof at a subsequent stage of engagement.
Figure 5C:
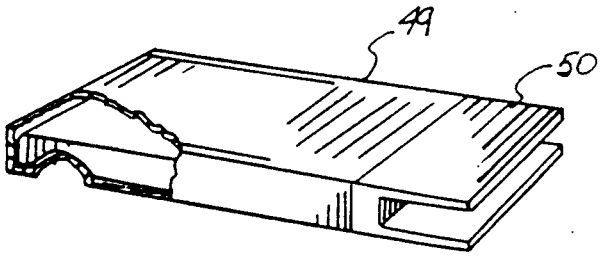
FIG. 5C is a view generally corresponding to the view of FIG. 5B and illustrating the male and female elements after the engagement is completed.

Male element 50 is preferably fabricated of a suitable metal or plastic which provides substantial rigidity. Female element 49, a thin walled structure, may also be fabricated of a suitable metal or plastic. At least the first sidewall 52 of female element 49 is spring tempered. Protrusion 60 is matingly engageable with recess 69. Accordingly, as the insertion proceeds in the direction of arrowed line B, as seen in FIG. 5B, first sidewall 52 is deflected upwardly in the direction indicated by the arrowed line C to allow the portion adjacent first end 67 of the male element 50 to pass over protrusion 60 and effect the engagement as seen in FIG. 5C. Indentation 69, protrusion 60 and sidewall 52 function as detent means for maintaining the engagement between the female element 49 and the male element 50. Within the detent arrangement, sidewall 52 functions as biasing means to maintain the engagement between the indentation and the protrusion.

Foot pad 40, in accordance with standard technology, is resilient for the comfort of the foot of the wearer. As a result of the inherent resiliency, foot pad 40 is deformable within localized areas to accommodate the deflection of sidewall 52 in the direction indicated by the arrowed line C. The pressure exerted by the foot of the wearer in the direction of arrowed line D, as seen in FIG. 4, reinforces the force of the biasing means for maintaining the engagement between the male element and the female element. It is also apparent, that since the elements of the male/female engagement pair can be disengaged only as a result of the application to components of forces in opposite directions along a line which is substantially parallel to the surface 25, the upward pressure of the foot against either upper in a direction which is perpendicular to the surface 25 as indicated by the arrowed line E does not tend to separate the upper from the sole.

Figure 6:
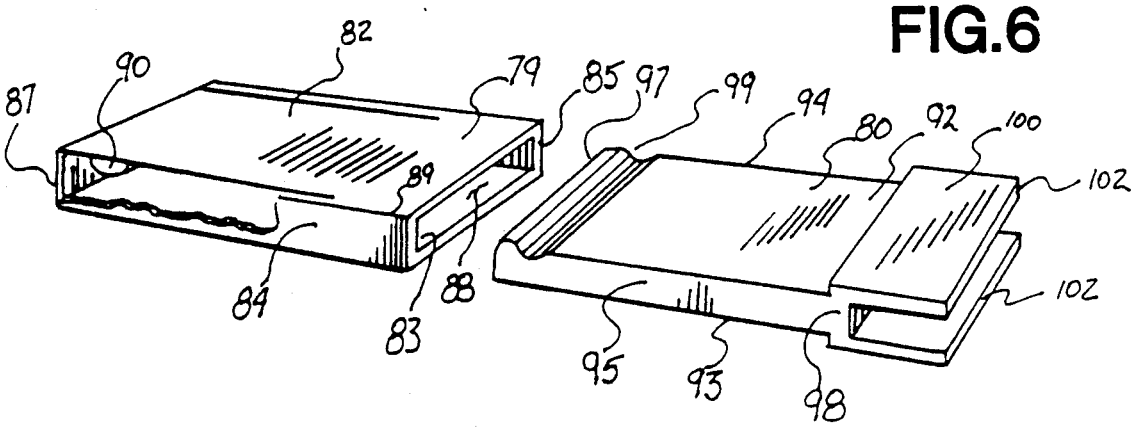
FIG. 6 is a view generally corresponding to the view of FIG. 5 and illustrating an alternate embodiment of the instant invention.

FIG. 6 illustrates an alternate male/female engagement pair which is usable in connection with the previously described convertible style shoe.

In general similarity to the previously described engagement pair, the immediate engagement pair includes female element 79 and male element 80. In further similarity, female element 79 includes first sidewall 82, second sidewall 83, edge walls 84 and 85, and end wall 87 which define a receptacle having an open end 88. First sidewall 82 is secured to the edge walls 84 and 85 for a distance extending from open end 88 and is separated from the edge walls and from the end wall 87 as shown by the line 89. Alternate to the previous embodiment, however, protrusion 90 is carried by first end wall 82.

Male element 80, again in similarity to the previously described counterpart, includes top surface 92, bottom surface 93, edges 94 and 95, and first and second ends 97 and 98. Indentation 99, for mating engagement with protrusion 90, is carried by top surface 92. For reasons previously described, attachment means 100 including lips 102 are carried proximate second end 98 and separated from the surfaces 92 and 93 by shoulders 103. As may be appreciated by those skilled in the art, male element 80 is previously described male element 50 which has been reoriented by rotating 180 degrees.

Figure 6A:
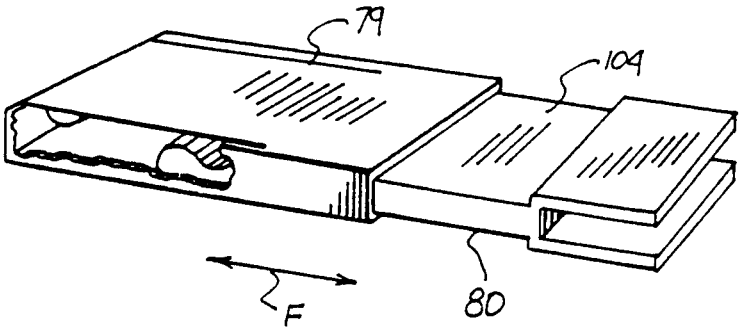
FIG. 6A is a view generally corresponding to the view of FIG. 6 and showing the engagement pair during an initial stage of engagement.
Figure 6B:
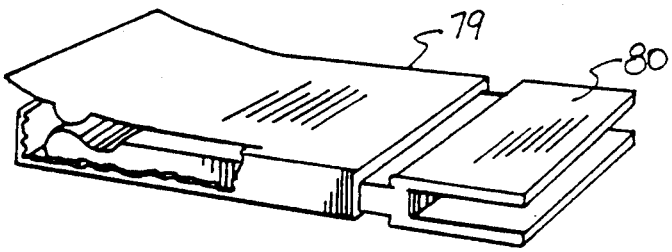
FIG. 6B is a view generally corresponding to the view of FIG. 6A and showing the components thereof at subsequent stage of engagement.
Figure 6C:
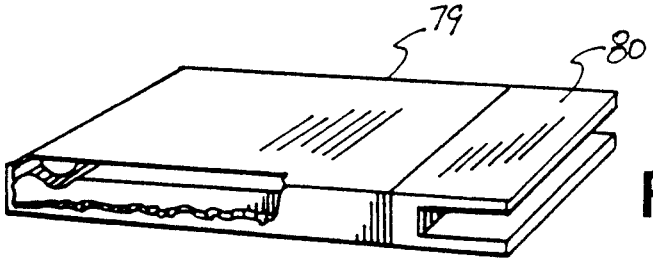
FIG. 6C is a view generally corresponding to the view of FIG. 6B and illustrating the male and female elements after the engagement is completed.

Top surface 92, bottom surface 93 and edges 94 and 95 define a lug 104 which is receivable, and alternately removable, into the receptacle of the female element in directions indicated by the double arrowed line F which is substantially parallel to the longitudinal axis of the engagement pair as seen in FIG. 6A. With further reference to FIGS. 6B and 6C, it is seen that the function and operation of the immediate engagement pair is analogous to the previously described engagement pair.

Figure 11:
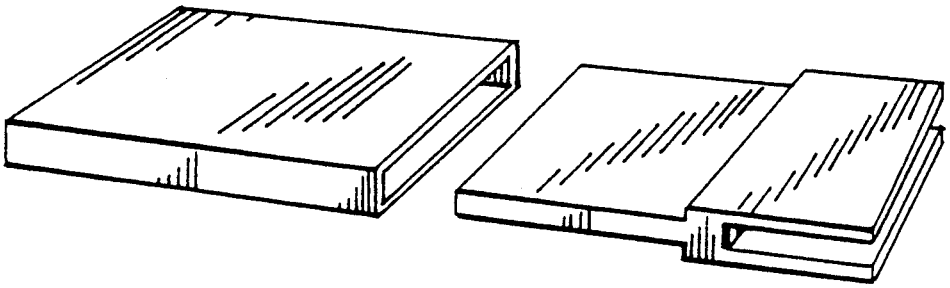
FIG. 11 is a view generally corresponding to the view of FIG. 5 and illustrating an alternate embodiment of the present invention.

FIG. 11 illustrates an alternate male/female engagement pair which is usable in connection with the previously described convertible style shoe.

In general similarity to the previously described engagement pair, the engagement pair of FIG. 11 includes a female element 180 and a male element 181. Female element 180 includes a first sidewall 182, a second sidewall 183, edgewalls 184 and 185, and end wall 186, all of which define a receptacle having an open end.

Male element 80 includes a top surface 188, bottom surface 189, edges 190 and 191, and first and second ends 192 and 193. Again, for reasons previously described, attachment means 100 including lips 102 are carried proximate second end 193 and separated from surfaces 188 and 189 by shoulders 103.

Figure 11A:
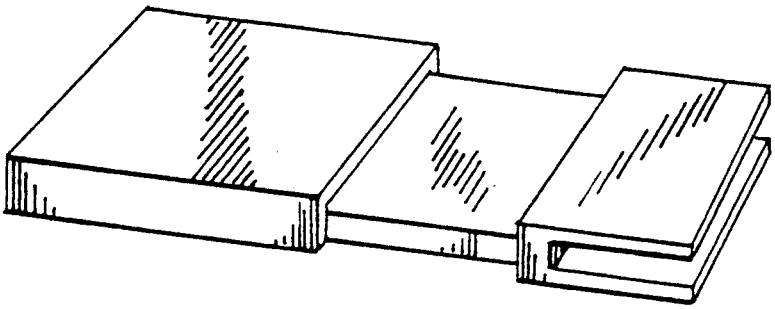
FIG. 11A is a view generally corresponding to the view of FIG. 11 and showing the engagement pair during an initial stage of engagement.
Figure 11B:
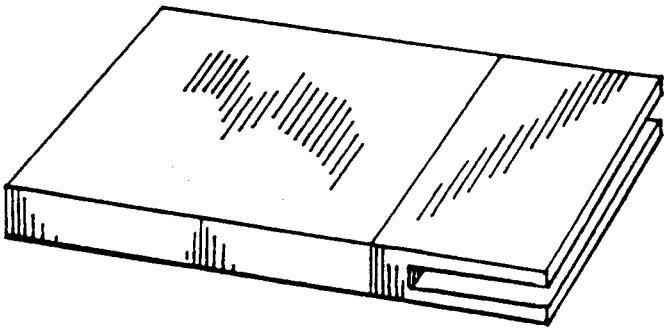
FIG. 11B is a view generally corresponding to the view of FIG. 11A and illustrating the male and female elements after engagement is completed.

Top surface 188, bottom surface 189, and edges 190, 191 and 192 define a lug 194 which is receivably, and alternately removable, into the receptacle of a female element in the directions indicated by the double arrowed line which is substantially parallel to the longitudinal axis of the engagement pair as is seen in FIG. 11A. With further reference to FIG. 11B, it is seen that the functional operation of the engagement pair is analogous to the previously described engagement pair with the following exception. Each of the male and female elements are made of a magnetic or ferro-magnetic material (e.g. metal or plastic impregnated with ferro-magnetic material) such that the magnetic attraction between the male and female members will favor the fully inserted position shown in FIG. 11B. The magnetic forces urging the male and female elements together in a fully inserted relationship such as shown in FIG. 11B must be overcome by pulling the female member out of the male member in order to separate the male and female members.

Figure 12:
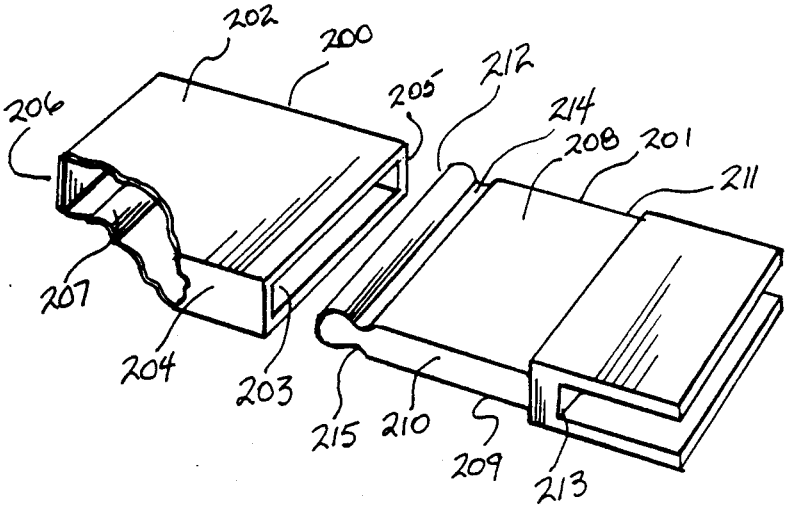
FIG. 12 is a view generally corresponding to the view of FIG. 5 and illustrating another alternative embodiment of the invention.
Figure 12A:
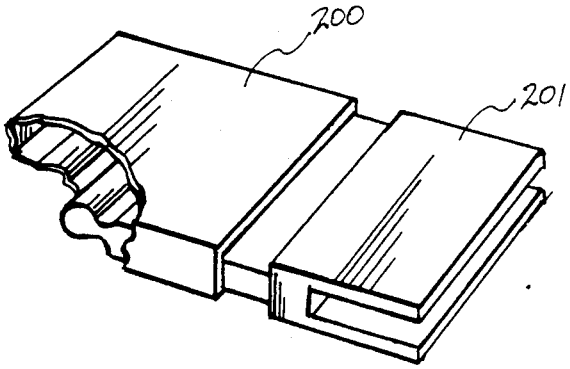
FIG. 12A is a view generally corresponding to the view of FIG. 12 and showing the engagement pair during an initial stage of engagement.
Figure 12B:
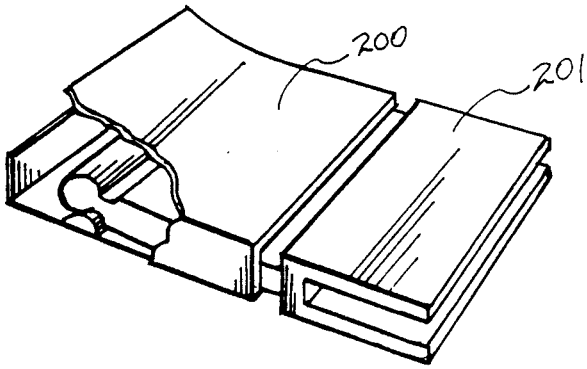
FIG. 12B is a view generally corresponding to the view of FIG. 12A and showing the components thereof at subsequent stage of engagement.
Figure 12C:
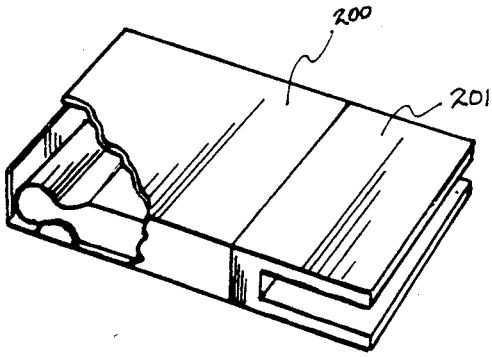
FIG. 12C is a view generally corresponding to the view of FIG. 12B and illustrating the male and female elements after the engagement is completed.

FIG. 12 illustrates another alternate male/female engagement pair which is usable in connection with the previously described convertible style shoe.

Again, in general similarity to the previously described engagement pairs, the engagement pair of FIG. 12 includes a female element 200 and a male element 201. Female element 200 includes a first sidewall 202, a second sidewall 203, edgewalls 204 and 205, and end wall 206, all of which define a receptacle having an open end. An inwardly directed protrusion 207 projects laterally across sidewall 203 proximate endwall 206.

Male element 201 includes top surface 208, bottom surface 209, edges 210 and 211, and first and second ends 212 and 213. In contrast to the embodiments of FIGS. 5 and 6, in which a single indentation, for mating engagement with protrusion 207, is carried by either the top or bottom surface of the male element, male element 201 includes a first indentation 214, carried by the top surface 208, and a second indentation 215, carried by the bottom surface 209. Because of this feature, male element 201 is symmetrical about a plane parallel to and midway between top and bottom surfaces 208 and 209. The symmetry enables male member 201 to engage female member 200 equally effectively regardless of which surface 209 or 209 is facing up, thus making the male member 201 reversible. In all other respects, the function and operation of the immediate engagement pair is analogous to the engagement pairs of FIGS. 5 and 6.

Figure 13:
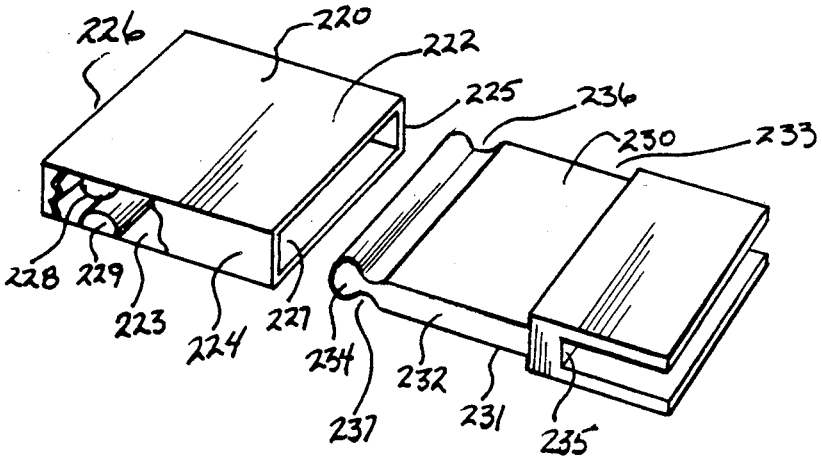
FIG. 13 is a view generally corresponding to the view of FIG. 5 and illustrating still another alternative embodiment of the invention.
Figure 13A:
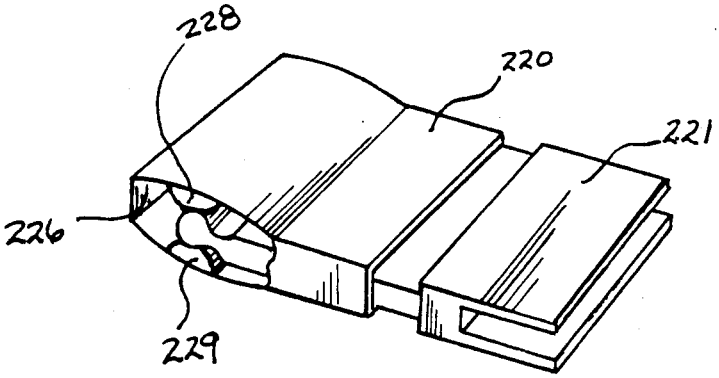
FIG. 13A is a view generally corresponding to the view of FIG. 13 and showing the engagement pair during an initial stage of engagement.
Figure 13B:
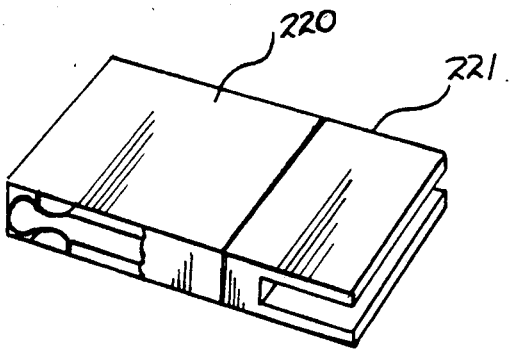
FIG. 13B is a view generally corresponding to the view of FIG. 13A and illustrating the male and female elements after the engagement is completed.

FIG. 13 illustrates yet another alternate embodiment of the engagement pair which is usable in connection with the previously described convertible style shoe.

The engagement pair of FIG. 13 includes female element 220 and male element 221. Female element 220 includes first and second substantially parallel sidewalls 222 and 223, respectively, held in spaced relationship by edge walls 224 and 225 and end wall 226. The several walls define a receptacle having an open end 227. Sidewalls 222 and 223, both of which are spring tempered, are each integral with or secured to edge walls 224 and 225 along a length thereof adjacent open end 227. For the remaining portion, sidewalls 222 and 223 are independent of edge walls 224 and 225. Both sidewalls 222 and 223 are secured to end wall 226. A first protrusion 228 extends laterally across sidewall 222 and a second protrusion extends laterally across sidewall 223 proximate endwall 226. Protrusions 228 and 229 are both curviform in cross-section.

Male element 221, including top surface 230, bottom surface 231, edges 232 and 233, first end 234, second end 235, and recesses 236 and 237, is identical in configuration to its counterpart in the embodiment of FIG. 12. As in the previous embodiment, its function will not be impaired if either the male element 221 or the female element 220 is inverted, because the top and bottom surfaces 230 and 231 are identical.

As male element 221 is inserted into female member 220, first sidewall 222 is deflected upwardly and second sidewall 223 is deflected downwardly, while still remaining secured to endwall 226. This allows the portion adjacent first end 234 of the male element 221 to pass between protrusions 226 and 228 and effect the engagement as seen in FIG. 23B. Indentations 236 and 237, protrusions 226 and 228, and sidewalls 222 and 223 together function as detent means for maintaining the engagement between female element 220 and male element 221. Within the detent arrangement, sidewalls 222 and 223 function as biasing means to maintain the engagement between the indentations 236, 237 and the protrusions 226, 228.

Figure 7:
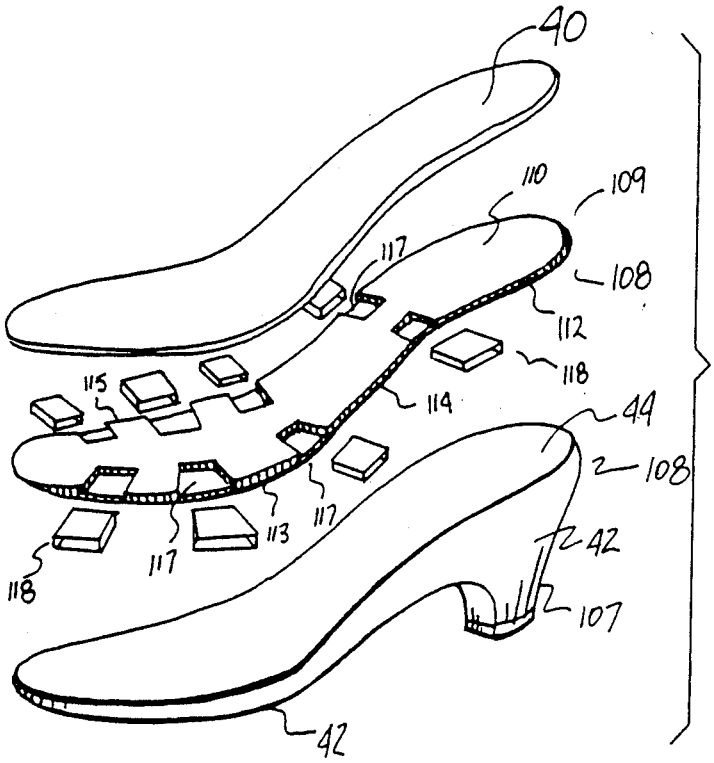
FIG. 7 is an exploded perspective view of the sole of an alternate footwear constructed in accordance with the teachings of the instant invention.

FIG. 7 illustrates an alternate convertible style shoe, generally designated by the reference character 107, embodying the principles of the instant invention. The immediate embodiment includes support member 108 including the previously described lower portion 42. In further similarity to the previously described embodiment, the immediate embodiment also includes foot pad 40.

The intermediate member, the upper portion 109 of support member 108, represents a modification of the previously described upper portion 43. The instant upper member 109 includes upper surface 110 which receives foot pad 40 thereon, under surface 112 which is bonded to the upper surface 44 of the lower portion 42, and a continuous sidewall 113 which is shaped so as to form spaced apart opposed edges 114 and 115. A plurality of recesses 117 are formed into upper member 109 from the top surface 110 and the sidewall 113. Each recess 117 is sized and shaped to receive a female element 118. The female element 118 is generically representative of the previously described female elements 49 and 79.

The sole described in connection with FIG. 7 is assemblable with the uppers 23 and 24 illustrated in FIGS. 1 through 4. In all other details not specifically set forth, shoe 107 is analogous to the previously described shoe 20.

Figure 8:
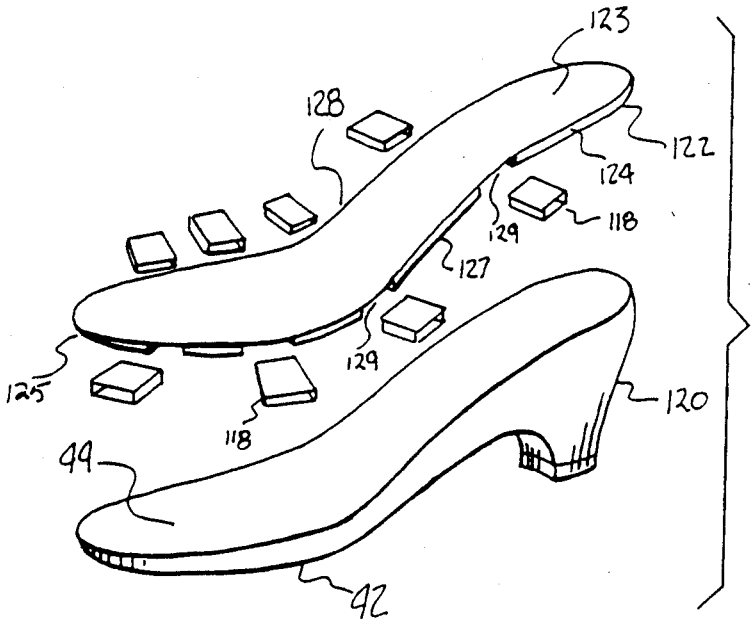
FIG. 8 is an exploded perspective view of yet another alternate embodiment of the instant invention.

Yet another embodiment of a convertible style shoe, generally designated by the reference character 120, is illustrated in FIG. 8. In common with the previously described embodiments, shoe 120 shares the lower portion 42 of the support member 39. In contrast thereto, however, the upper portion of the support member and foot pad appear as an integral unit shown as alternate foot pad 122 having top surface 123, under surface 124 and continuous sidewall 125 which is shaped to provide a pair of opposed edges 127 and 128.

Being of substantially greater thickness than the previously described foot pad, foot pad 122 has a plurality of recesses 129 formed therein. The recesses which are formed into the under surface 124 are also exposed along respective edges 127 and 128. Each recess is sized and shaped to receive a female element 118 therein. In other aspects not specifically described, the immediate embodiment is generally similar to the previously described embodiments including the attachment of the uppers 23 and 24.

Figure 9:
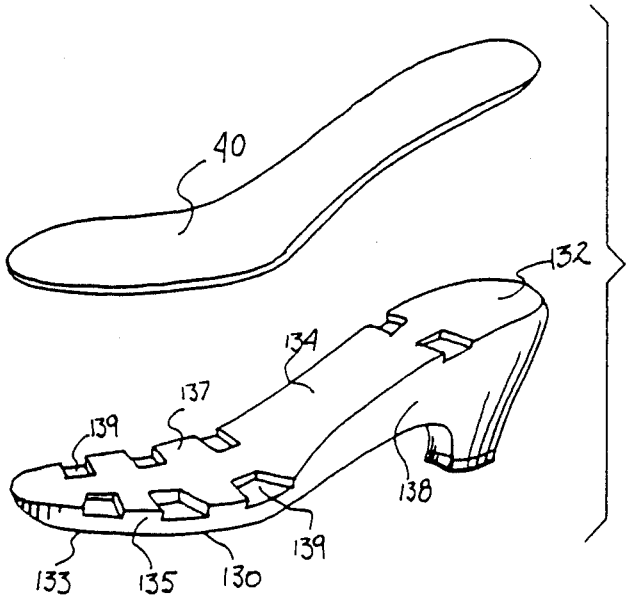
FIG. 9 is a perspective view of still another embodiment of a sole for footwear embodying the principles of the instant invention.

With respect to FIG. 9 there is seen yet another convertible style shoe of the instant invention generally designated by the reference character 130. Included in the immediate embodiment is an alternate support member 132 and previously described foot pad 40. Support member 132 includes bottom surface 133, upper surface 134 and opposed edges 135 and 137 which are portions of continuous sidewall 138. A plurality of recesses 139 are molded, cut or otherwise formed into support member 132 to be exposed in the upper surface 134 and the sidewall 138. As will be appreciated by those skilled in the art, a female element 118 is receivable within each recess 139, foot pad 40 is bonded to surface 134, and uppers 23 and 24 may be detachably affixed thereto to form a shoe having a general appearance of the footwear seen in FIG. 1.

Figure 10:
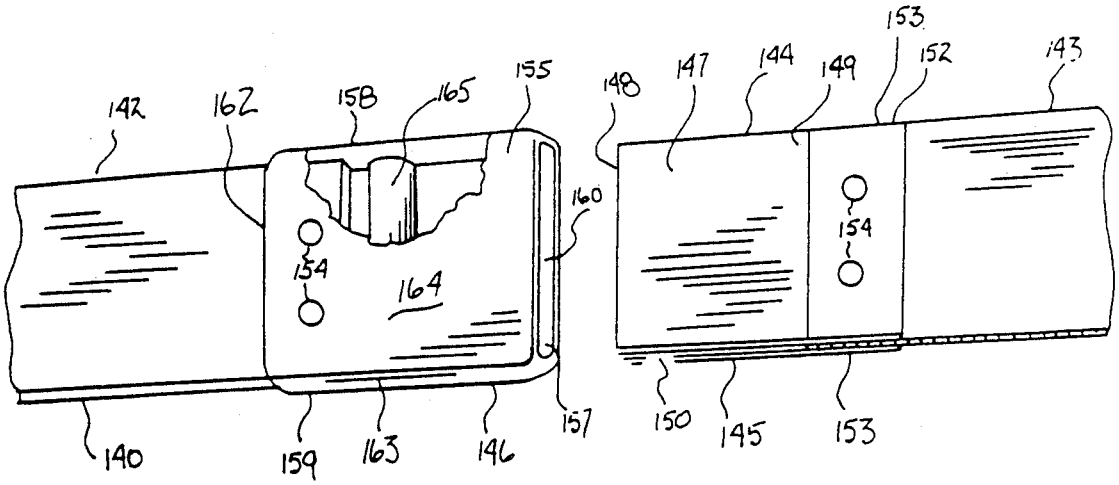
FIG. 10 is a perspective view of another alternate embodiment of a male/female engagement pair according to the instant invention as it would appear when being employed for the purpose of detachably securing a first component to a second component, such as the ends of a belt.

The male/female engagement pair of the instant invention has further utility as a clasp for detachably securing a first component to a second component. Reference is now made to FIG. 10 which illustrates a belt, generally designated by the reference character 140, having first and second terminal end portions 142 and 143. A clasp, generally designated by the reference character 144 and embodying the principles of the instant invention, detachably secures first end portion 142 to second end portion 143. Clasp 144 being an alternate embodiment of the previously described male/female engagement pairs includes male element 145 and female element 146.

Male element 145 includes lug 147 having first end 148 and second end 149. Indentation 150 is formed in lug 147 proximate first end 148. Engagement means 152 for affixing end portion 143 are carried proximate second end 149. In the immediate embodiment, the engagement means includes a pair of spaced apart lips 153 for receiving the end portion 143 therebetween and a pair of rivets 154 which extend through the lips and the end portion 143.

Female element 146, in general analogy to female elements 49 and 79, includes first and second sidewalls 155 and 157, respectively, edges 158 and 159 and first and second open ends 160 and 162, respectively. A portion of second sidewall 155 is secured to edges 158 and 159 along a length adjacent each open end 160 and 162 and is severed from the edges 158 and 159 along an intermediate length by a slit as represented by the line 163. While only one line 163, appearing at the intersection of sidewall 155 and edge 159, is seen in the immediate illustration, it will be appreciated that a corresponding slit appears between the sidewall 155 and the edge 158. For purposes of reference, the portion of sidewall 155 intermediate slits 163 is designated as the portion 164. Transverse inwardly directed protrusion 165 is carried by sidewall 157 at a location substantially opposite portion 164.

As in the previously described embodiments, lug 147 is removable through open end 160 into the receptacle formed by the several sidewalls and edges of female element 146. Indentation 150 is matingly engageable with protrusion 165. Portion 164 will flex sufficiently to accommodate the engagement. Further, portion 164 functions as biasing means in cooperation with indentation 150 and protrusion 164 as detent means for maintaining the detachable engagement between the male and female elements. As will be appreciated by those skilled in the art, protrusion 165 may be carried by portion 164.

First end portion 142 of belt 140 is receivable within female element 146 through open end 162. Additional rivets 154 extend through the sidewalls 155 and 157 and end portion 142. Accordingly, the sidewalls 155 and 157 and rivets 154 function as engagement means for affixing first end portion 142 to female element 146. When the belt 140 with clasp 144 of the instant invention is worn about the torso of a person in accordance with conventional practice, with sidewall 155 inwardly, the pressure of the torso against portion 164 reinforces the biasing means to further insure disengagement between the male and female components in a matter analogous to the pressure of the foot as previously described.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the instant invention and alternate embodiments thereof in such clear and concise terms as to enable those skilled in the art to understand and practice the same, the invention claimed is:

1. A clasp for detachably securing a first member to a second member, said clasp comprising:

(a) a female element couplable to said first member and including
  (i) an open end,
  (ii) a closed end spaced from the open end,
  (iii) a pair of spaced apart edgewalls,
  (iv) a first sidewall having
    a first portion integral with said pair of edgewalls along a length thereof adjacent said open end, and
    a second portion integrally extending from said first portion toward said closed end and independent said pair of edgewalls, and
  (v) a second sidewall having
    a first portion integral with said pair of edgewalls along a length thereof adjacent said open end, and
    a second portion integrally extending from said first portion toward said closed end and independent said pair of edgewalls;

(b) a male element including
  (i) a first end couplable to said second member, and
  (ii) a second end spaced from said first end and receivable through the open end of said female element; and (c) detent means for selectively and detachably retaining said male element within said female element, said detent means comprising an engagement pair including
  (i) first engagement means carried by said female element at a location closer to said closed end than to said open end, and (ii) second engagement means matingly engageable with said first engagement means and carried by said male element at a location closer to the second end thereof than to the first end thereof.

2. The clasp of claim 1, wherein said first engagement means comprises a pair of opposed engagement members carried on the sidewalls of said female element.

3. The clasp of claim 1, wherein (a) said male element comprises a pair of opposite sides, and (b) said second engagement means comprises a pair of complemental engagement members formed on said opposite sides of said male element.

4. The clasp of claim 1, wherein (a) one of said engagement means of said engagement pair comprises a pair of opposed indentations; and (b) the other of said engagement means of said engagement pair comprises a pair of protrusions.

* * * * *